US005268669A

United States Patent [19]

Roskowski

[11] Patent Number: 5,268,669

[45] Date of Patent: Dec. 7, 1993

[54] SENSING APPARATUS

[75] Inventor: Steven G. Roskowski, Sunnyvale, Calif.

[73] Assignee: Apple Computer, Inc., Cupertino, Calif.

[21] Appl. No.: 452,253

[22] Filed: Dec. 18, 1989

[51] Int. Cl.[5] ..... G08B 1/08

[52] U.S. Cl. ..... 340/534; 340/825.29; 340/825.94; 324/66

[58] Field of Search ..... 340/534, 825.07, 825.08, 340/825.29, 825.3, 825.56, 825.75, 825.85, 825.94; 324/66

[56] References Cited

U.S. PATENT DOCUMENTS

| | | | |
|---|---|---|---|
| 3,613,078 | 10/1971 | Manning et al. | 340/825.29 |
| 3,719,816 | 3/1973 | Darmon et al. | 340/825.94 |
| 4,151,374 | 4/1979 | Fukuhara et al. | 340/825.94 |
| 4,991,123 | 2/1991 | Casamassima | 340/525 |

*Primary Examiner*—Donnie L. Crosland

*Attorney, Agent, or Firm*—Blakely, Sokoloff, Taylor & Zafman

[57] ABSTRACT

A connector utilizing a number of electrical connectors wires equal to the number used to provide the static binary indications of the particular piece of equipment attached to the device, and further including diodes and direct connections between the electrical connectors arranged to provide a number of unique coded readouts when each of the individual ones of the electrical connectors are interrogated.

8 Claims, 3 Drawing Sheets 11 00 00

00 11 00

00 00 11

00 10 10

10 00 01

01 01 00

11 11 10

11 10 11

10 11 11

11 11 01

00 10 11

00 11 00

11 00 01

11 01 00

00 11 10

10 00 11

11 00 11

00 11 11

11 11 00

10 11 01

01 01 11

11 10 10

11 01 01

01 11 10

10 10 11

11 11 11

00 00 00

SENSING APPARATUS

BACKGROUND OF THE INVENTION

1. Field of the Invention

This invention relates to sensing apparatus and, more particularly, to methods and apparatus for sensing a particular piece of electronic equipment which may be attached to a computer system capable of operating with many different types of equipment.

2. History of the Prior Art

Personal computers are designed to be used by persons of varying capabilities. For example, they may be used persons having no background in computer operation or theory whatsoever or by persons who themselves design computers. One way to make a single type of computer appeal to persons having a very broad spectrum of backgrounds is to design the computer to hide from the operator many of the technical details necessary to the operation by performing those details automatically. The line of MacIntosh personal computers manufactured by Apple Computer Company, Cupertino, Calif., emphasizes this philosophy in its design.

One way that this is accomplished in certain of the MacIntosh computers is to make the computers able to determine the various pieces of peripheral equipment connected to the central processing unit so that the operator need not do this during system set up. For example, the bandwidth, number of lines, numbers of pixels per line, height, and width are among the characteristics which vary from monitor to monitor. It is necessary for the central processing unit to know the characteristics of the particular output display monitor to which it is connected in order to present the information correctly on the display monitor. One method of automatically telling the central processing unit that a particular video output monitor is attached is to provide a three wire connector between the main body of the computer and the video output monitor. The three wires allow eight distinct binary numbers to be sensed by the central processing unit, each of which is used to indicate a different monitor.

However, with the growth of this particular line of computers, it has become apparent that many more than eight monitors may be used with these computers. Consequently, provision must be made for indicating to the central processing unit that one of a much larger number of monitors is connected to provide output for the system. Moreover, because the three wire system is already implemented for a large number of systems in use, it is very desirable that the three wire system continue to function in the same manner to indicate that one of the already designated output monitors is connected yet provide the additional facility to indicate the presence of many additional monitors. In addition, the lack of more pin-out terminals on particular pieces of equipment already set to provide three terminals for such a detection system, emphasizes the need to maintain the three wire design.

SUMMARY OF THE INVENTION

It is, therefore, an object of the present invention to provide a new arrangement for indicating a large number of different peripheral devices which may be connected to any particular terminal of a digital electronic device.

It is another more specific object of the present invention to provide an arrangement for indicating a large number of different peripheral devices which may be connected to any particular terminal of a digital electronic device which will operate without interfering with a presently available binary coding system.

It is yet another more specific object of the present invention to provide an inexpensive arrangement for indicating a large number of different peripheral devices which may be connected to any particular terminal of a digital electronic device which will operate with a three wire binary coding system without interfering with that system.

These and other objects of the present invention are realized in a sensing arrangement utilizing a connector having a number of electrical conductors equal to the number used to provide the static binary indications of the particular piece of equipment attached to the device, and further including diodes and direct connections between the electrical connectors arranged to provide a number of unique coded readouts when signals are placed on each of the individual ones of the electrical conductors and the others of such conductors are interrogated.

These and other objects and features of the invention will be better understood by reference to the detailed description which follows taken together with the drawings in which like elements are referred to by like designations throughout the several views.

NOTATION AND NOMENCLATURE

Some portions of the detailed descriptions which follow are presented in terms of algorithms and symbolic representations of operations on data bits within a computer memory. These algorithmic descriptions and representations are the means used by those skilled in the data processing arts to most effectively convey the substance of their work to others skilled in the art.

An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to apparatus and to method steps for operating a computer in processing electrical or other (e.g. mechanical, chemical) physical signals to generate other desired physical signals.

DETAILED DESCRIPTION OF THE INVENTION

Figure 1:
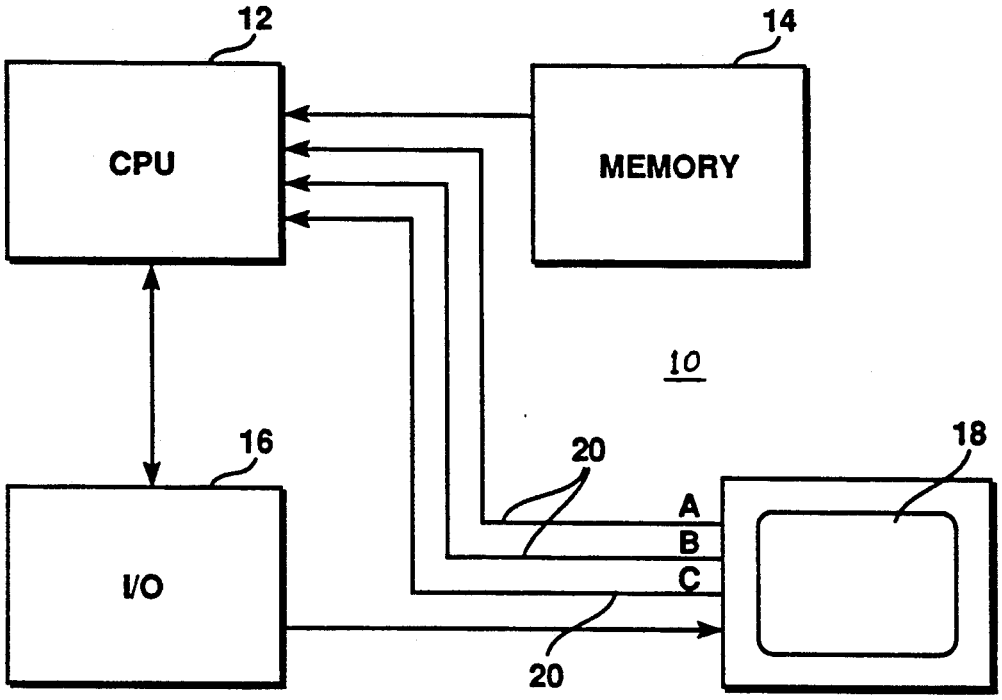
FIGURE 1 (Prior Art)
FIG. 1 is a block diagram illustrating a prior art arrangement of a computer system and a peripheral device including means for ascertaining the particular piece of peripheral equipment which is connected.

Referring now to FIG. 1 there is illustrated in block diagram form a computer system 10 including a central processing unit 12, memory 14, input/output circuitry 16, and output display monitor 18. The system 10 illustrated in FIG. 1 functions in a manner well known to those skilled in the art to execute under control of the central processing unit 12 computer programs which may be stored in memory 14 and, among other things, display output resulting from those programs on the output display monitor 18.

Because different output display monitors have different operating and physical characteristics, it is necessary for the central processing unit 12 to understand which particular output display monitor 18 is connected to the system in order that the results provided be displayed properly. For example, a particular monitor may be capable of displaying a first number of horizontal scan lines, each line having a given number of pixels while another monitor may display an entirely different number of lines and pixels per line. One monitor may provide an image which is taller than it is wide while another may provide an image which is wider than it is tall. One monitor may produce its output in color, another may provide black or white, while a third may provide shades of gray. All of these characteristics are important to the central processing unit 12 in presenting its results correctly on the particular monitor 18 to which it is connected.

With most personal computers, the operator provides information to the central processing unit 12 during the original setup of the operating system or whenever the setup is changed to indicate those pieces of peripheral equipment which are attached. Often the information which must be provided to indicate the particular pieces of peripheral equipment are obscure to neophyte (or even advanced) computer operators. Consequently, an arrangement has been devised to allow the central processing unit 12 to sense a coded indication of the particular piece of peripheral equipment which is connected to a particular terminal of the system. The coded indication obviates the need for the operator to provide the setup information regarding the particular peripheral. The coded indication is simply used to derive information about the peripheral stored for use by the central processing unit 12.

FIG. 1 illustrates the use of such an arrangement in the computer system 10. In the system 10, a three wire connector 20 connects the monitor 18 to the central processing unit 12. Within the monitor 18, a three bit binary indication is encoded and appears on the three wires A, B, and C of the connector 20. In the usual situation, the wires are provided voltage signal levels by the attached monitor equal to the high and low signals used by the central processing unit 12 of the system 10 for its normal encoding of information. By sensing the bits of the binary coded indication provided on the three wires, the central processing unit 12 may easily ascertain the monitor 18 which is connected to the system.

Since three wires are provided within the conductor 20 and a zero or a one may be present on any of the three wires, eight binary combinations may be represented. Thus a total of eight different monitors 18 may be defined using the prior art system. However, a great number more than eight monitors are available which may appeal to different users of personal computers. Consequently, it is necessary to either provide for these additional monitors at setup of the system 10 or devise a new method of indicating which particular monitor 18 is connected to the system 10. The problem is somewhat more complicated because, once the sensing system has been built into some computers and monitors sold for use therewith, it is desirable to be able to continue the use of that system for those devices already in use. Hence, it is desirable to continue the use of the three wire coding system and have it continue to indicate by binary code the same monitors as it has in the past. In this manner devices already manufactured may continue to be used with new systems without modification.

Figure 2A:
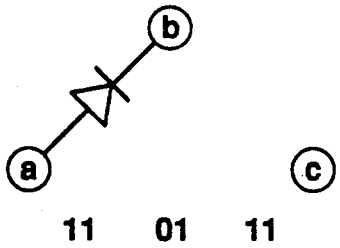
FIG. 2(*a*) and 2(*b*) illustrates two arrangements for providing a unique binary coded response to interrogation by a computer.
Figure 2B:
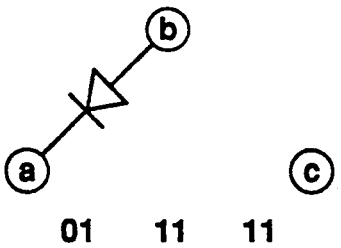
Figure 4:
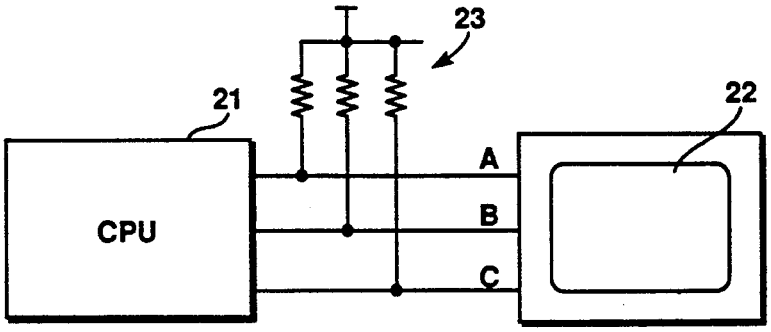
FIG. 4 is a block diagram illustrating details of a computer system connected to a piece of peripheral equipment in accordance with the present invention.

FIG. 2(*a*) illustrates a three wire conductor 20 having lines A, B, and C. A normal three wire conductor 20 would be capable of providing the binary signals discussed for defining eight individual monitors to be connected to a computer system 10. FIG. 4 illustrates circuitry by which this may be accomplished. A resistor 23 is connected to each wire A, B, and C and to a voltage indicating a one condition. Any wire A,B, or C which is grounded at the monitor 22 will indicate a zero condition while the other lines remain at the voltage of a one condition. Under normal conditions, the three wires A, B, and C are sensed and the condition of the terminals indicates the coded binary response through the voltage condition of the three wires. For example, line A might be in a one condition while the other two lines are in the zero condition. If all codes but a default code (for example, all ones) are used, then seven individual monitors may be detected by static sensing of the wires. However, connecting the lines A and B in FIG. 2(*a*) of the conductor 20 is a diode 22. Even with the diode 22 in place, a default code of one on all three wires will be returned during static sensing of the lines to indicate that dynamic sensing may take place.

The method of dynamic sensing proposed by this invention is to have the central processing unit place a low value on each wire A, B, and C in turn and with each assertion of the low signal read the value of the other two wires. Thus for the arrangement of FIG. 2(*a*), if wire A goes low, then the diode 22 does not conduct so wire B remains high. Wire C is not affected and remains high. When wire B goes low, the diode 22 conducts so that wire A is also low while wire C is not affected. When wire C goes low, neither wire A nor B is affected. Thus, the connection allows a unique six bits to be read from the wires. This may be accomplished by a simple state machine which provides an output to indicate the particular code received and thus the monitor involved.

A second arrangement for connecting the wires A, B, and C is illustrated in FIG. 2(*b*). In this case the direction of the diode 22 connecting wires A and B is reversed. This produces the pattern of signals illustrated below the connection diagram when the wires are driven low in the order ABC and the other two wires are sensed with each assertion of the low condition.

Figure 3A:
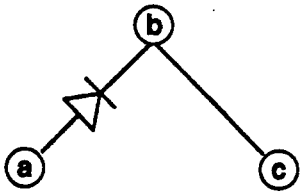
FIG. 3(*a*) through 3(*AA*) illustrate a number of individual arrangements for providing unique binary coded responses to interrogation in accordance with the present invention.
Figure 3B:
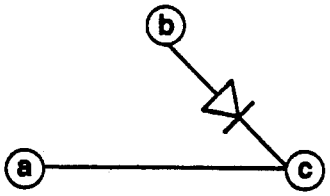
Figure 3C:
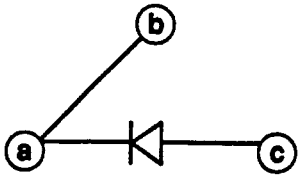
Figure 3D:
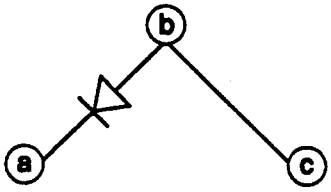
Figure 3E:
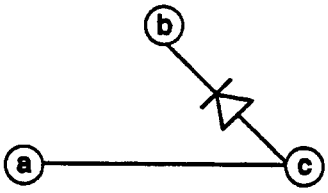
Figure 3F:
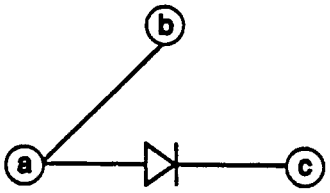
Figure 3G:
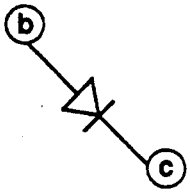
Figure 3H:
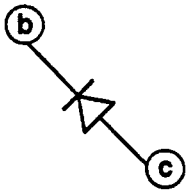
Figure 3I:
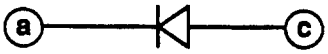
Figure 3J:
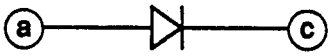
Figure 3K:
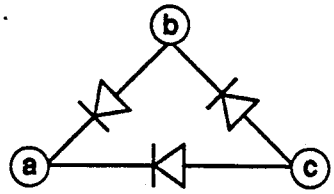
Figure 3L:
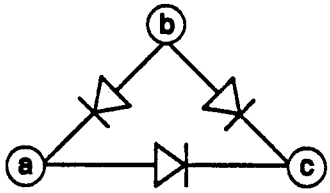
Figure 3M:
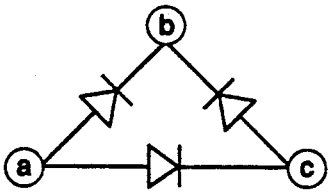
Figure 3N:
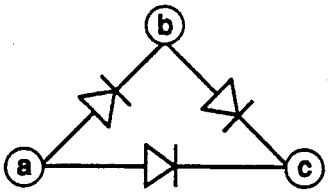
Figure 3O:
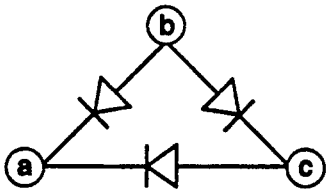
Figure 3P:
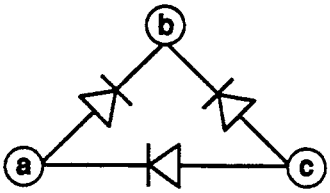
Figure 3Q:
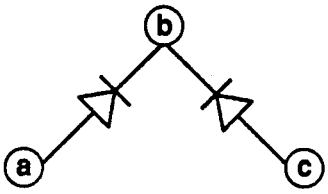
Figure 3R:
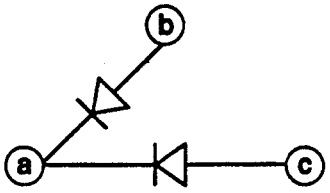
Figure 3S:
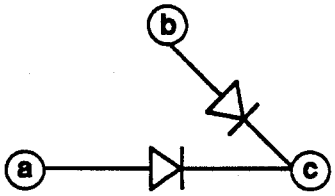
Figure 3T:
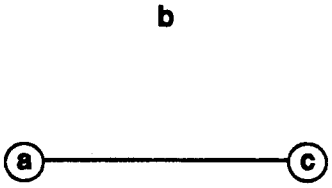
Figure 3U:
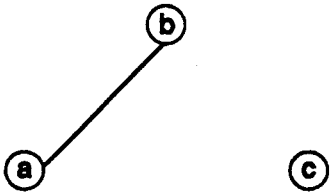
Figure 3V:
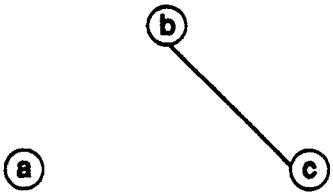
Figure 3W:
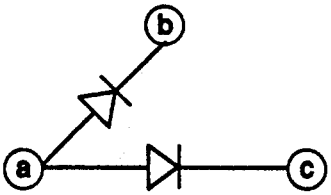
Figure 3X:
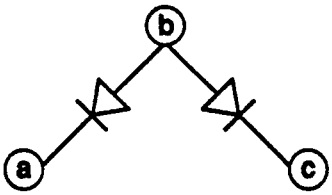
Figure 3Y:
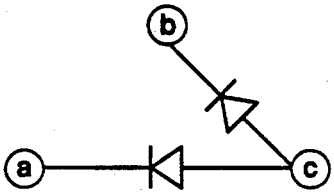
Figure 3Z:
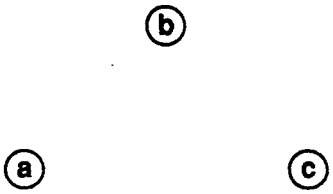
Figure 3:
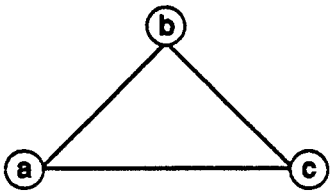

FIGS. 3(*a*) through 3(AA) indicate twenty-seven other connections which might be made between the three wires A, B, and C and the outputs associated with the dynamic interrogation of those wires given the connections described. A total of seven static indications of monitors and twenty-eight dynamic indications are therefore possible still using only the three wires of the prior art. It will be obvious to those skilled in the art that the idea may be extended to include more wires and a variety of interconnections to cover a much larger number of monitors. Moreover, it will be obvious that the system may be used to indicate differences in other types of computer peripherals than monitors.

Another extension of the invention is to vary the static values so that instead of a default of all ones being used, the wires A, B, and C are individually selectively grounded at the monitor, then diode or direct connection of the other two wires will provide additional codings. For example, wire A might be grounded at the monitor while wires B and C are connected by diodes in one of the other direction, directly connected or not connected. In such a case, both static and dynamic testing would take place for all monitors.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. An arrangement for providing to an electrical device an identification of a particular piece of equipment attached to the device comprising a connector utilizing a number of electrical conductors each coupling the electrical device to the piece of equipment, means for connecting individual ones of the electrical conductors together so that the voltage on one of the conductors affects the voltage on another one of the conductors, means for placing a first voltage on each of the conductors, means for providing a second voltage to each of the conductors in sequence, and means for sensing a voltage on each of the other conductors as the second voltage is provided to each of the conductors in sequence, wherein the means for sensing generates the identification when the means for sensing completes sensing the voltage on each of the other conductors as the second voltage is provided to each of the conductors in sequence.

2. An arrangement for providing to an electrical device an identification of a particular piece of equipment attached to the device as claimed in claim 1 in which the means for connecting individual ones of the electrical conductors together so that the voltage on one conductor affects the voltage on another one of the conductors comprises at least one diode connecting one of the electrical conductors to another of the electrical conductors.

3. An arrangement for providing to an electrical device an identification of a particular piece of equipment attached to the device as claimed in claim 1 in which the means for connecting individual ones of the electrical conductors together so that the voltage on one conductor affects the voltage on another one of the conductors comprises a first diode connecting one of the electrical conductors to another of the electrical conductors, and a second diode connecting one of the electrical conductors to a third of the electrical conductors.

4. An arrangement for providing to an electrical device an identification of a particular piece of equipment attached to the device as claimed in claim 1 in which the number of conductors is three, and in which the means for connecting individual ones of the electrical conductors together so that the voltage on one conductor affects the voltage on another one of the conductors comprises three diodes each connecting one of the electrical conductors to another of the electrical conductors.

5. An arrangement for providing to an electrical device an identification of a particular piece of equipment attached to the device as claimed in claim 1 in which the means for connecting individual ones of the electrical conductors together so that the voltage on one conductor affects the voltage on another one of the conductors comprises at least one additional electrical conductor connecting one of the electrical conductors to another of the electrical conductors.

6. An arrangement for providing to an electrical device an identification of a particular piece of equipment attached to the device as claimed in claim 5 in which the means for connecting individual ones of the electrical conductors together so that the voltage on one conductor affects the voltage on another one of the conductors comprises in additional a diode connecting one of the electrical conductors to another of the electrical conductors.

7. An arrangement for providing to an electrical device an identification of a particular piece of equipment attached to the device as claimed in claim 1 in which the means for connecting individual ones of the electrical conductors together so that the voltage on one conductor affects the voltage on another one of the conductors comprises means conductively connecting each one of the electrical conductors to another of the electrical conductors.

8. An arrangement for providing to an electrical device an identification of a particular piece of equipment attached to the device as claimed in claim 1 in which the number of the electrical conductors is three.

* * * * *